US008936412B1

(12) United States Patent
Haydu

(10) Patent No.: US 8,936,412 B1
(45) **Date of Patent: *Jan. 20, 2015**

(54) COVER FOR A LIQUID RESERVOIR

(75) Inventor: Joseph Haydu, Riverside, CA (US)

(73) Assignee: Versaflex, Inc., Riverside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/550,015

(22) Filed: Jul. 16, 2012

Related U.S. Application Data

(63) Continuation of application No. 12/497,431, filed on Jul. 2, 2009, now Pat. No. 8,221,030.

(51) Int. Cl.
*E03B 11/00* (2006.01)

(52) U.S. Cl.
CPC ..... *E03B 11/00* (2013.01)
USPC ..... 405/52; 210/170.05; 405/216

(58) Field of Classification Search
USPC ..... 220/216, 218, 219; 210/170.05; 405/52, 405/63, 65, 66, 70
See application file for complete search history.

(56) References Cited

U.S. PATENT DOCUMENTS

| | | | |
|---|---|---|---|
| 1,666,415 | A | 4/1928 | Gallagher |
| 2,036,372 | A | 4/1936 | Stough |
| 2,798,633 | A | 7/1957 | Cornell et al. |
| 2,970,716 | A | 2/1961 | McCammon |
| 3,119,204 | A | 1/1964 | Williams |
| 3,474,931 | A | 10/1969 | Creith et al. |
| 3,517,513 | A | 6/1970 | Trippe et al. |
| 3,640,038 | A | 2/1972 | Heron |
| 3,683,428 | A | 8/1972 | Morris |
| 3,690,502 | A | 9/1972 | Guber, Jr. |
| 3,779,192 | A | 12/1973 | Gonzalez |
| 3,827,204 | A | 8/1974 | Walters |
| 3,862,810 | A | 1/1975 | Welch |
| 3,922,823 | A | 12/1975 | King et al. |
| 3,951,085 | A | 4/1976 | Johnson et al. |
| 3,974,789 | A | 8/1976 | de Groot |
| 4,000,527 | A | 1/1977 | Gannon |
| 4,036,394 | A | 7/1977 | Bodley et al. |
| 4,047,357 | A | 9/1977 | Mulholland et al. |
| 4,058,947 | A | 11/1977 | Earle et al. |
| 4,275,679 | A | 6/1981 | Finsterwalder |

(Continued)

FOREIGN PATENT DOCUMENTS

| | | |
|---|---|---|
| FR | 2 816 647 | 11/2000 |
| WO | WO 01/06072 A1 | 1/2001 |

OTHER PUBLICATIONS

Bridge Preservation, Bridge Deck Membrane System: "Cold Liquid-Applied Elastomeric Membrane" Waterproofing System, Versaflex, Inc., pp. 8.

*Primary Examiner* — Tara M. Pinnock
(74) *Attorney, Agent, or Firm* — Knobbe Martens Olson & Bear LLP

(57) ABSTRACT

A seismic-resistant fluid reservoir cover includes a plurality of panels and a network of flexible membranes coupled to adjacent panels. The flexible membranes are made of a potable water approved material, and the panels and the membranes create a fluid tight seal. Each panel in the reservoir cover is able to move along three directional axes independently of the adjacent panels while maintaining the fluid tight seal, at least in part because of the flexibility or the slack in the flexible membrane. A support member, such as a backer rod, may also be positioned in the spaces between the panels.

20 Claims, 9 Drawing Sheets

(56) References Cited

U.S. PATENT DOCUMENTS

| | | | |
|---|---|---|---|
| 4,720,947 | A | 1/1988 | Yacaboni |
| 4,784,516 | A | 11/1988 | Cox |
| 4,927,291 | A | 5/1990 | Belangie |
| 5,007,765 | A | 4/1991 | Dietlein et al. |
| 5,020,294 | A | 6/1991 | Duda |
| 5,024,554 | A | 6/1991 | Benneyworth et al. |
| 5,168,683 | A | 12/1992 | Sansom et al. |
| 5,624,204 | A | 4/1997 | Dorsemaine |
| 5,649,784 | A | 7/1997 | Ricaud et al. |
| 5,766,474 | A | 6/1998 | Smith et al. |
| 6,039,503 | A | 3/2000 | Cathey |
| 6,338,169 | B1 | 1/2002 | DeGarie |
| 6,357,964 | B1 | 3/2002 | DeGarie |
| 6,497,533 | B2 | 12/2002 | DeGarie |
| 6,517,285 | B2 | 2/2003 | Hill |
| 6,666,618 | B1 | 12/2003 | Anaya et al. |
| 6,898,910 | B2 | 5/2005 | Bellino, Jr. |
| 6,932,540 | B2 | 8/2005 | Svirklys et al. |
| 7,374,059 | B2 | 5/2008 | Morgan et al. |
| 8,221,030 | B1 | 7/2012 | Haydu |
| 2002/0061229 | A1 | 5/2002 | DeGarie |
| 2002/0131822 | A1 | 9/2002 | Hill |
| 2004/0187235 | A1 | 9/2004 | Elias et al. |
| 2004/0200835 | A1 | 10/2004 | Song |
| 2007/0023432 | A1 | 2/2007 | Seow |

COVER FOR A LIQUID RESERVOIR

CROSS-REFERENCE TO RELATED APPLICATION

This application is a continuation of U.S. application Ser. No. 12/497,431 filed on Jul. 2, 2009, which is hereby incorporated by reference in its entirety herein.

BACKGROUND OF THE INVENTION

1. Field of the Invention

This application relates to covers for water reservoirs.

2. Background of the Related Art

Open-air water reservoirs are frequently used to store drinking water, but pollutants, for example toxic chemicals, animal waste, plants, microorganisms, and even dead animals can easily enter uncovered reservoirs. Covering a reservoir impairs the introduction of pollutants into the reservoir. However, a reservoir cover may be required to maintain a fluid tight cover over hundreds of acres of surface area. For example, a modest size reservoir may have a surface area of 1,000 acres, and a large reservoir may have a surface area that exceeds 25,000 acres.

In addition to covering a large surface area, a reservoir cover must be able to maintain the fluid tight seal over the large area while withstanding powerful seismic events, such as an earthquake, during which panels of the reservoir cover may be displaced from each other independently in all three directional axes. According to the U.S. Geological Survey, each year about 18 major earthquakes occur, which have a magnitude between 7.0 and 7.9, as well as one great earthquake of magnitude 8.0 or greater. Additionally, annually there are dozens of earthquakes between 6.0 and 6.9, and thousands of smaller earthquakes. By way of comparison, an increase of 1.0 in magnitude indicates an increase of 32 times in the energy of an earthquake, and an increase in 10 times in ground displacement. The reservoir cover must be able to withstand these events. Also, the panels of a reservoir cover may be coupled to other panels on every side, thus subjecting the individual panels to forces on every side that are generated by the movement of adjacent panels. Moreover, not only must a reservoir cover withstand the released energy and displacement without collapse, but it must also maintain the fluid tight seal.

Furthermore, since reservoir covers are intended to define a space beneath the cover, the panels of a reservoir cover may be designed with minimal structural support beneath them in order to increase the available space beneath the cover. Finally, a reservoir cover must be water potable to avoid polluting any water in the reservoir. Thus, in a reservoir cover that is made of panels, the panels must be coupled together with connections or joints durable enough to withstand a powerful seismic event that moves the panels independently of each other along three directional axes and displaces the panels to a large magnitude along each axis and withstand forces generated from the movement of surrounding adjacent panels with minimal structural support underneath, while maintaining a water potable cover that is large enough to cover the reservoir with a fluid tight seal.

It is known to provide seals to bridge deck joints, but the seals on bridge deck joints are not potable water approved. Furthermore, bridges have only a fraction of the surface area of a reservoir and may allow runoff of fluids over the side of the bridge. Also, bridge deck joint seals are not designed to withstand independent movement along three axes of direction during a seismic event, nor are bridge deck joint seals designed to withstand the magnitude of potential displacement that may be experienced by the panels of a reservoir cover. Also, bridge sections are often coupled to other sections on only two sides and are thus not exposed to the forces generated by the movement of adjacent sections on all four sides. Finally, bridge deck joints may have more structural support beneath them, for instance along the length of the joint.

Therefore, there is a need for joints that allow panels to be coupled together to form a fluid tight seal over a large surface area while being durable enough to allow the panels to move independently of each other and to a large magnitude of displacement along three directional axes with minimal structural support underneath, while at the same time being water potable.

SUMMARY OF THE INVENTION

The systems, methods, and devices of the invention each have several aspects, no single one of which is solely responsible for its desirable attributes. Without limiting the scope of the invention, certain features will now be discussed briefly.

In one embodiment, a reservoir cover comprises a plurality of cover structures that define interlocking channels, a network of flexible membranes that are positioned to extend vertically downward into the interlocking channels and that define a plurality of substantially orthogonal intersections, the membranes comprising flange portions and being made of a potable water approved material, an adhesive positioned on an interface of the upper portion of the cover structures and the flange portions of the membranes to adhere the membranes to the cover structures, and an outer coating positioned over the flanges, over the adhesive, and over at least part of the upper portion of the cover structures, wherein the membranes, the adhesive, and the outer coating form a substantially fluid impenetrable barrier.

In one embodiment, a fluid reservoir cover comprises a plurality of panels that define interlocking channels and a network of flexible membranes positioned to extend vertically downward in the interlocking channels, the membranes comprising a water potable material and comprising flange portions, wherein at least a portion of the flange portions project across an upper surface of the panels and are coupled to an upper surface of the respective panels to define a substantially horizontal seal that is substantially fluid tight.

In one embodiment, a method of forming a reservoir cover comprises positioning a plurality of panels to define interlocking channels, applying an adhesive layer to a dorsal surface of the plurality of panels, positioning a network of membranes at least partially within in the interlocking channels, wherein the network of membranes comprises flanges and wherein the flanges contact the adhesive layer when the network of membranes is positioned within the interlocking channels, and applying an outer layer to at least a portion of a surface of the flanges.

DETAILED DESCRIPTION

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
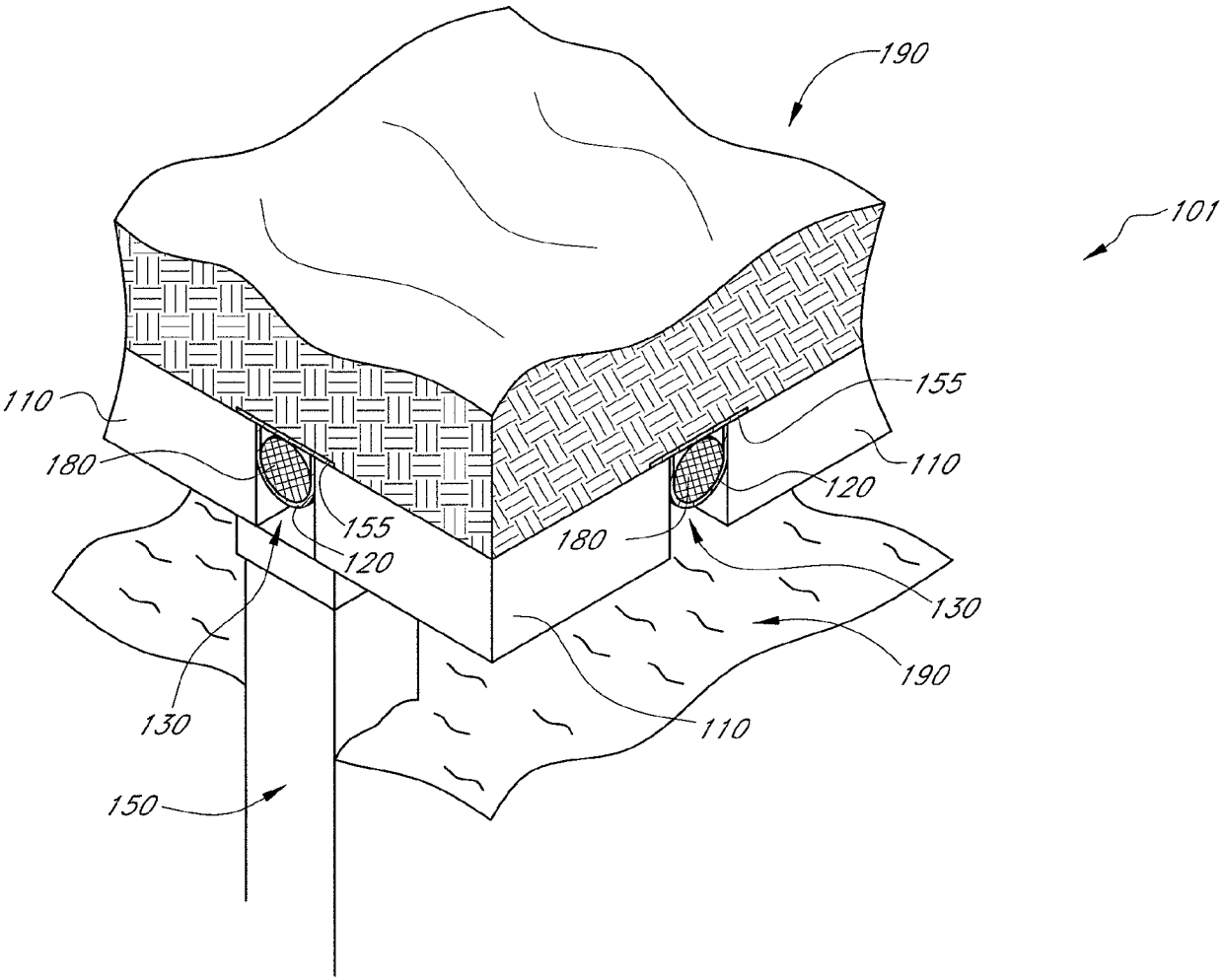
FIG. 1 is a perspective cross-sectional view of one embodiment of a fluid-tight seismic-resistant reservoir cover.

FIG. 1 illustrates a perspective cross sectional view of one embodiment of a water potable fluid-tight seismic-resistant fluid reservoir cover 101. The cover 101 may have a plurality of panels 110 that define channels 130, such as expansion joints, between the panels 110. The cover 101 may also define a space below it which may contain a fluid 160, such as water. The cover 101 may be supported by vertical support members 150, though different supports may be used in other embodiments. For example, in one embodiment the cover 101 may be supported on a framework of metal girders. A membrane 120 may be coupled to and/or positioned at least partially between the adjacent panels 110 and may create a substantially fluid impenetrable seal. Depending on the embodiment, the fluid impenetrable seal may be substantially impenetrable to liquids. In other embodiments, the fluid tight seal may be substantially impenetrable to gases or substantially impenetrable to both gases and liquids. The seal may prevent the penetration of fluids or dirt through the covering formed by the panels 110, such as through the channels 130. The membrane 120 may also couple adjacent panels 110 to one another. The cover 101 may also include a protective plate 155 that is positioned over the channels 130 and the membrane 120. The protective plate 155 may be configured to slide over and/or detach from the panels 110 to allow the protective plate 155 to move with the panels' 110 movements without breaking. Also, a support member 180, which will be explained in more detail below, may be positioned in the channel 130. The cover 101 may be buried beneath other materials 190, such as dirt or water, without permitting any of the other materials 190 to penetrate the seal.

Figure 2A:
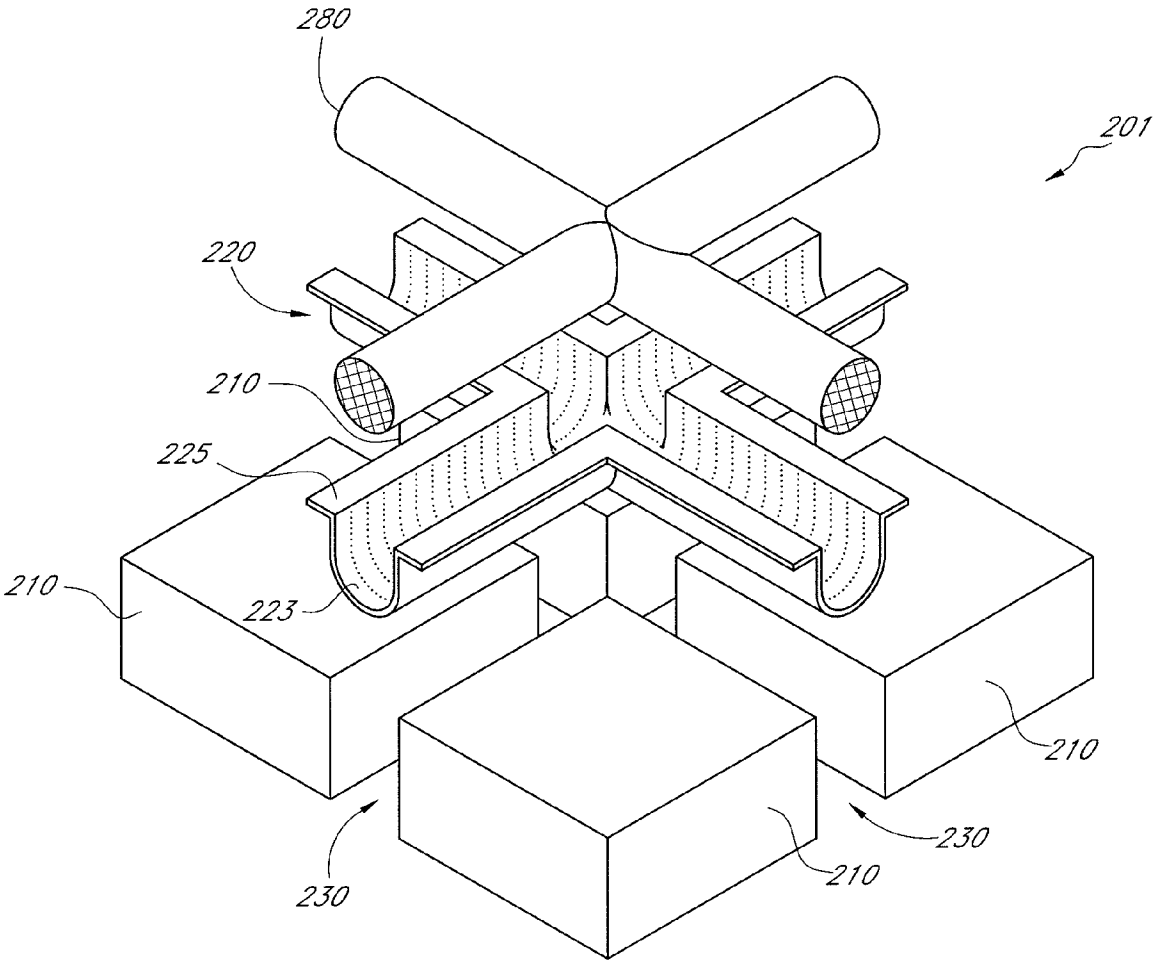
FIG. 2A is an exploded perspective cross-sectional view of one embodiment of a fluid-tight seismic-resistant reservoir cover.

FIG. 2A illustrates an exploded perspective cross sectional view of one embodiment of a potable fluid-tight seismic-resistant reservoir cover 201. The cover 201 has panels 210 that may be made of concrete or reinforced concrete, but may also be made of any other material durable enough and impermeable enough to form a water potable fluid tight barrier over the reservoir and withstand the forces applied to the panels 210, and, in some embodiments, may be metal or plastic. The material of the panels 210 may also be selected to resist any corrosive effects caused by the substances the panels 210 are exposed to, such as water. Also, the panels 210 may be of any dimension that allows them to form the cover. In one embodiment the panels are each about 100 feet by 100 feet by 8 inches, but the panels may have other dimensions. For example, the panels may be about 50 feet by 50 feet by 10 inches, about 25 feet by 25 feet by 5 inches, or any other suitable dimension. Also, the panels may be a different shape, for example a trapezoidal, triangular, or rectangular shape.

In the embodiment shown in FIG. 2A, the panels 210 define channels or expansion joints 230 that allow the panels 210 to expand or contract during changes in thermal conditions and/or to move independently of each other, for example when a seismic wave propagates through the cover 201. Also in the embodiment shown, expansion joints 230 may form substantially orthogonal intersections, though other shapes of intersections may be formed in other embodiments. The expansion joints 230 may be any size that allows for proper movement of the panels 210 and may vary in size with the dimensions of the panels 210. In one embodiment, the expansion joints are approximately six inches across, though in other embodiments the expansion joints may be of a different size, for example three inches across.

The panels 210 in the embodiment shown in FIG. 2A are coupled together by a membrane 220 that is positioned at least partially within the expansion joints 230. The membrane 220 may comprise a substantially fluid impermeable material and may be water potable. Also, the membrane 220 may comprise a substantially flexible material, such as an elastomer. In one embodiment, the membrane 220 comprises a polyurea, such as AquaVers 405™, available from VersaFlex, Inc., of Kansas City, Kans. The membrane 220 may be flexible enough to permit the membrane 220 to deform in any direction without damage according to the movement of the panels 210 that the membrane 220 is coupled to except for the most severe dislocations of the panels 210. For example, the membrane 220 may be able to deform, such as elongate, to at least 50% of its non-stressed dimension along any axis without damage. The membrane 220 may be thick enough to provide the durability required to withstand the stresses placed on the membrane 220 while maintaining the fluid tight seal while remaining flexible enough to allow the membrane 220 to deform as the panels 210 move, and is about 80 to 100 millimeters thick in one embodiment, though the membrane 220 may be another thickness, for example about 50 to about 150 millimeters thick, and may have a varying thickness throughout.

The membrane 220 may also have flanges 225 that extend substantially laterally from edges of the groove 223. The flanges 225 may be positioned proximate to the dorsal surface of the panels 210. The membrane 220 may be coupled to the panels 210 at only the flanges 225, which may provide additional slack for the membrane. The slack may allow greater movement when the panels 210 are displaced from an initial position. Thus, in embodiments in which the membrane 220 is coupled to the panels 210 at only the flanges but in which the membrane 220 still comes into contact with part of one or more panels 210 within the channel 230, the membrane 220 may be partially or completely separated from contact with the part of the one or more panels 210 that are within the channel 230 without stretching the membrane. Accordingly, the flexibility of the membrane 220 and/or the slack in the membrane 220 allow the panel to be displaced along multiple directional axes to a large magnitude before damage is sustained by the membrane 220 or the coupling between the membrane 220 and the panels, thereby maintaining the fluid tight seal even during and after severe displacements of the panels 210. Furthermore, in some embodiments the membrane 220 provides a restoring force to help move the panels 210 substantially back to an initial position.

The membrane 220 may define a groove 223. The groove 223 may be in a substantially semicylindrical shape or another shape. The groove 223 may be substantially positioned below a dorsal surface of the panels 210 so as to be positioned substantially between adjacent panels 210. The flange 225 and the groove 223 may be made of the same materials or different materials and may be integrally connected.

The flanges 225 may be coupled to the surface of the panels 210 to define a substantially fluid tight seal that is substantially horizontal, and in which the seam is located on the dorsal surface of the panels 210. Also, in some embodiments, the membrane may be coupled to a surface of the panels 210 inside the channels 230 to define a substantially vertical seal that is substantially fluid tight, thereby creating both a substantially horizontal seal and a substantially vertical seal. The flanges 225 may permit the membrane 220 to be coupled to the panels 210 without the presence of a seam in the groove 223. The absence of a seam in the groove 223 reduces the possibility that fluids or debris that may accumulate within the groove 223 will penetrate the membrane 220 because there will not be a seam in the groove 223 that could potentially fail, thereby breaching the seal and permitting passage of fluids and/or debris.

In this embodiment, a support member 280 is positioned within the groove 223. The support member 280 may be compressible and may be a closed cell structure or a rubber cell structure. In one embodiment, the support member 280 is a closed cell foam backer rod. The support member 280 may be made of a polyurethane or polyethylene material, which may be extruded, and may be a substantially cylindrical shape or any other shape that allows the support member 280 to be placed in the groove 223. The shape of the support member 280 may be selected to correspond to the shape of the groove 223. The support member 280 may prevent the accumulation of water and other deleterious materials in the membrane, may buffer the panels 210, and may also help secure the membrane 220 in position. Also, the support member 280 may be attached to the membrane 220, for example with an adhesive.

Figure 2B:
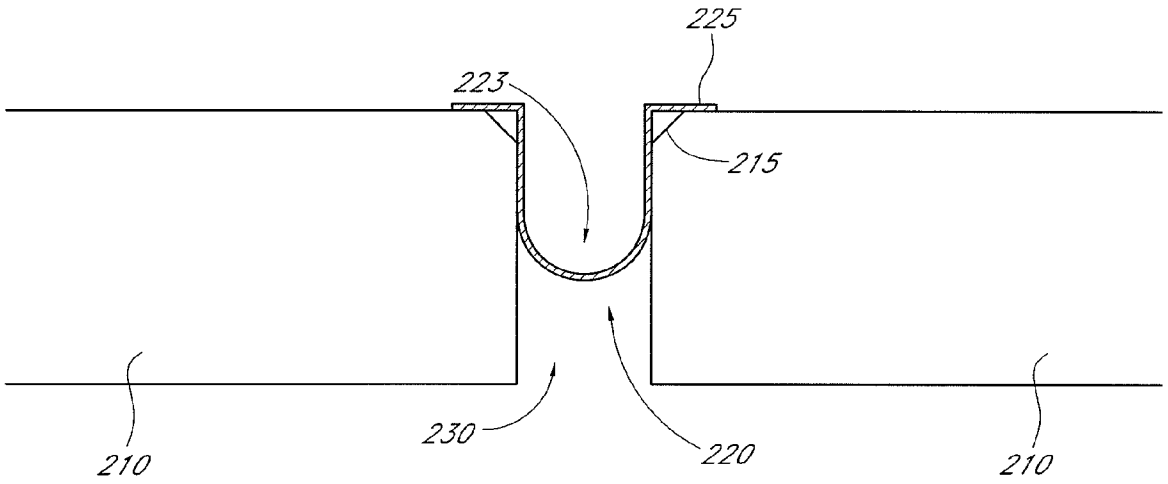
FIG. 2B is a cross-sectional view of one embodiment of a fluid-tight seismic-resistant reservoir cover.

FIG. 2B shows a cross sectional view of one embodiment of a membrane 220 joined to two adjacent panels 210. The panels 210 in the embodiment shown both have chamfered edges 215. The membrane 220 may be positioned so that the groove 223 of the membrane 220 is disposed in the channel 230. The flanges 225 may be proximal to the dorsal surface of the panels 210. As shown in FIG. 2B, the membrane 220 may not be flush with the chamfered edges 215 of the panels 210.

Figure 2C:
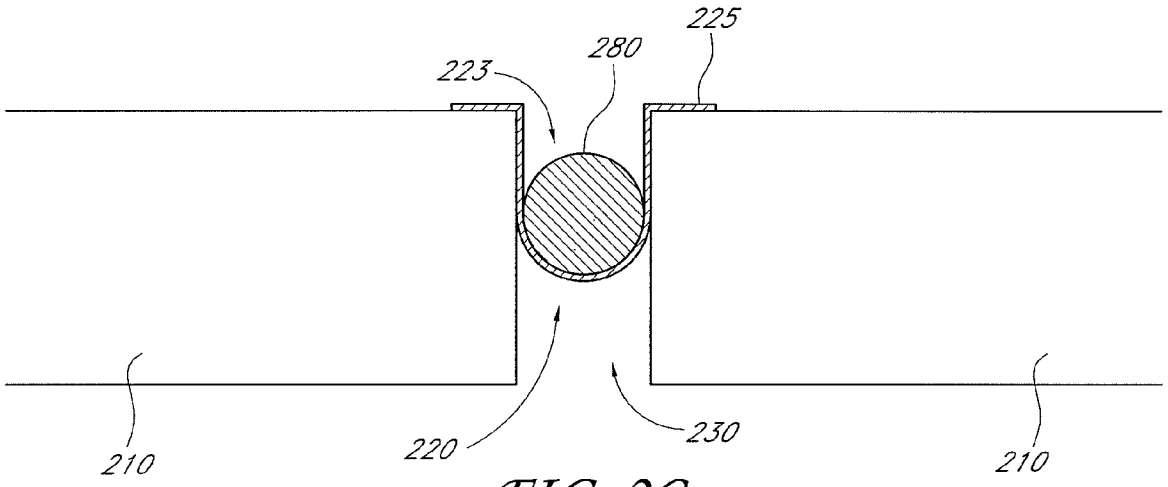
FIG. 2C is a cross-sectional view of another embodiment of a fluid-tight seismic-resistant reservoir cover.

FIG. 2C shows a cross sectional view of another embodiment of a membrane 220 joined to two adjacent panels 210. The membrane 220 in this embodiment lays substantially flush with the chamfered edges 215 of the panels 210. Also, a support member 280 is disposed in the groove 223 of the membrane 220.

Figure 3A:
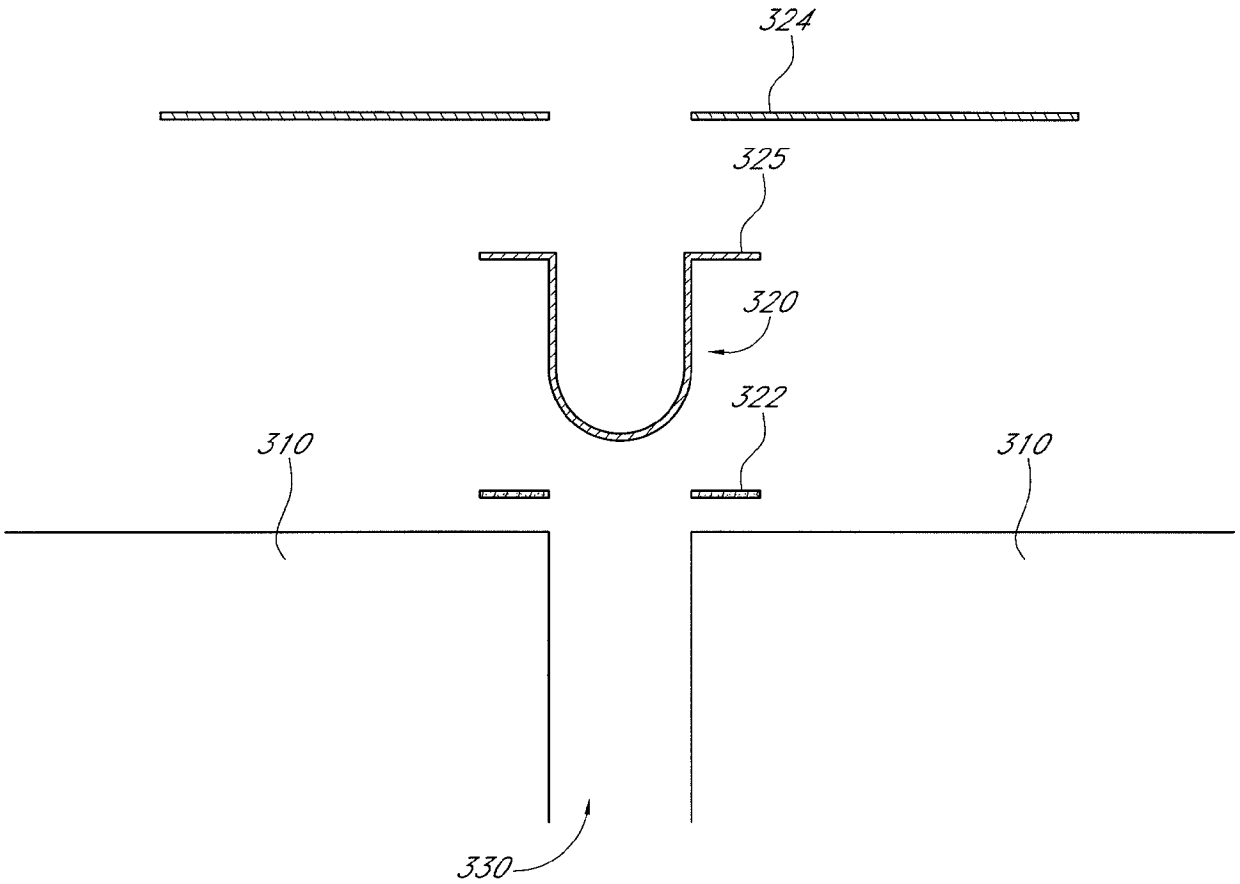
FIG. 3A is an exploded cross-sectional view of one embodiment of a fluid-tight seismic-resistant reservoir cover.

FIG. 3A shows one embodiment of an exploded cross sectional view of a membrane 320 and adjacent panels 310. Between a flange 325 and a panel 310 is an adhesive layer 322. The adhesive layer 322 may be a primer application, be applied prior to the placement of the membrane 320, and adhere to both the panel 310 and the membrane 320. The adhesive layer 322 may be the same material as all or part of the membrane 320, such as a polyurea, and may be applied by spraying the material while it is in a substantially fluid state. The adhesive layer 322 includes an adhesive capable of bonding with the panels 310 and the membrane 320. In some embodiments, the adhesive layer is not applied to the surface of the panels 310 within the channel 330.

The outer layer 324 is applied to the membrane 320 on the side of the membrane 320 distal to the panels 310. The outer layer 324 may cover part of or all of the flanges 325 and/or the adhesive layer 322, and/or may also cover part or all of one or more surfaces of the panel 310, such as the entire dorsal surface. The outer layer 324, the flange 325, and the adhesive layer 322 define a substantially horizontal fluid tight seal on the surface of the panels 310. In embodiments in which the outer layer 322 covers the entire dorsal surface of the panel 310 there will be no seams in the outer layer, which may strengthen the fluid tight seal. The outer layer 324 may be any thickness capable of covering the membrane 320, the panel 310, and/or the adhesive layer 322. For example, in one embodiment, the outer layer is between 10 and 150 millimeters thick, and may be 80 to 120 millimeters thick. The outer layer 324 is a substantially fluid impermeable material, for example, a polyurea. The outer layer 324 may be applied by spraying substantially fluid material on the panel 310, membrane 320, and/or adhesive layer 322 to form a layer of generally consistent thickness.

Figure 3B:
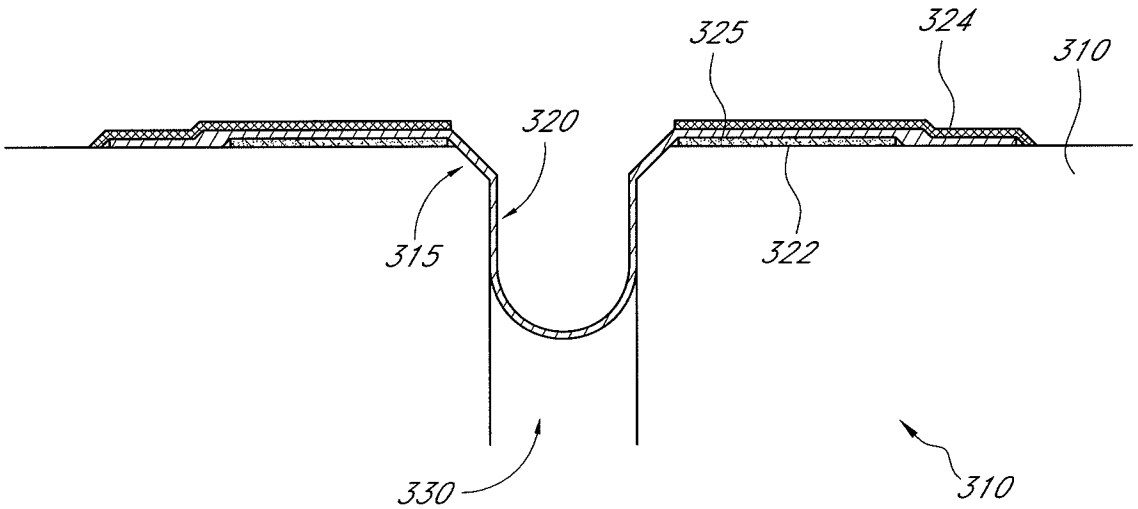
FIG. 3B is a cross-sectional view of one embodiment of a fluid-tight seismic-resistant reservoir cover.

FIG. 3B illustrates a cross sectional view of one embodiment of the membrane 320, the panels 310, the adhesive layer 322, and the outer layer 324. In this embodiment, the outer layer 324 covers only a portion of the dorsal surface of the panel 310. The flange 325 of the membrane is substantially sandwiched between the adhesive layer 322 and the outer layer 324. In this embodiment, no part of the adhesive layer is applied to the chamfer 315 on the panel 310 or on a surface of the panel 310 in the channel 330, but in other embodiments some or all of the adhesive layer may be applied to the chamfer 315 or on a surface of the panel 310 in the channel 330. Also, the outer layer may cover the chamfer 315 and/or a surface of the panel 310 within the channel 330. The adhesive layer 322, the membrane 320, and/or the outer layer 324 may form a monolithic system, such as when the adhesive layer 322, membrane 320, and outer layer 324 are the same material. The substantially horizontal fluid tight seal formed by the adhesive layer 322, the membrane 320 and/or the outer layer 324 advantageously increases the distance a fluid must penetrate before breaching the seal and prevents a failure in the seal.

Figure 4A:
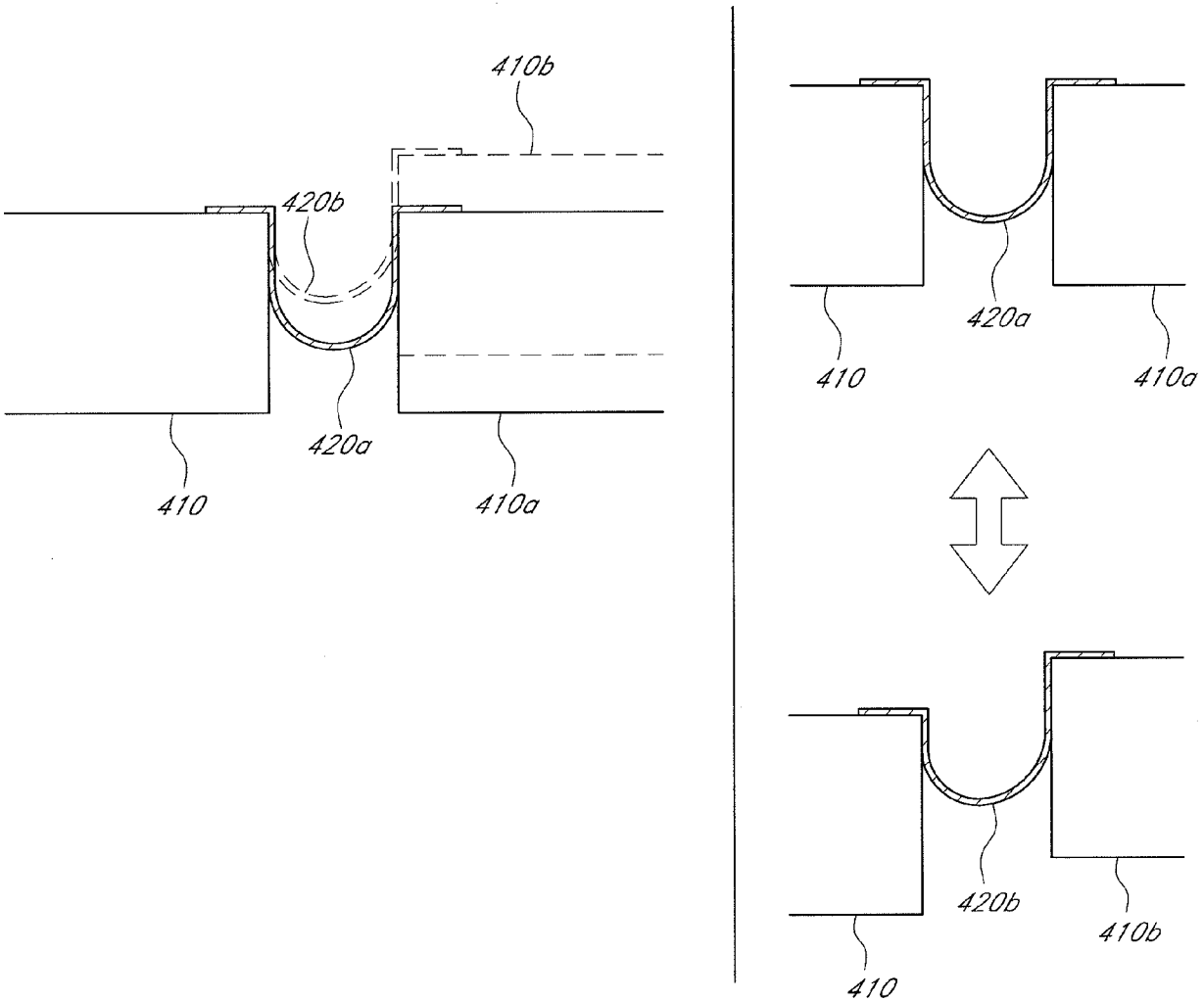
FIG. 4A is a cross-sectional view of one embodiment of a fluid-tight seismic-resistant reservoir cover showing vertical displacement of a panel.

FIG. 4A is a cross-sectional view of one embodiment of a fluid-tight seismic-resistant reservoir cover showing vertical displacement of a panel. In FIG. 4A, two panels 410 and 410*a* are coupled together by a membrane 420*a*. The panel 410*a* is displaced from the position shown, such as by a wave (e.g., a seismic wave), to the position illustrated by the panel 410*b*. The membrane 420*a* is flexible and stretches to position 420*b* while maintaining a substantially fluid tight seal and remaining coupled to the panels 410 and 410*b*. The position shown by the membrane 420*b* and the panel 410*b* is presented for illustrative purposes, and may be another position than the one illustrated by the membrane 420*b* and the panel 410*b* if the panel 410*a* is displaced more or less than the position shown by 410*b*. During events that cause extreme dislocations, substantially all of the membrane 420*b* may be positioned near a horizontally-extending plane created by the dorsal surface of the panel 410.

Figure 4B:
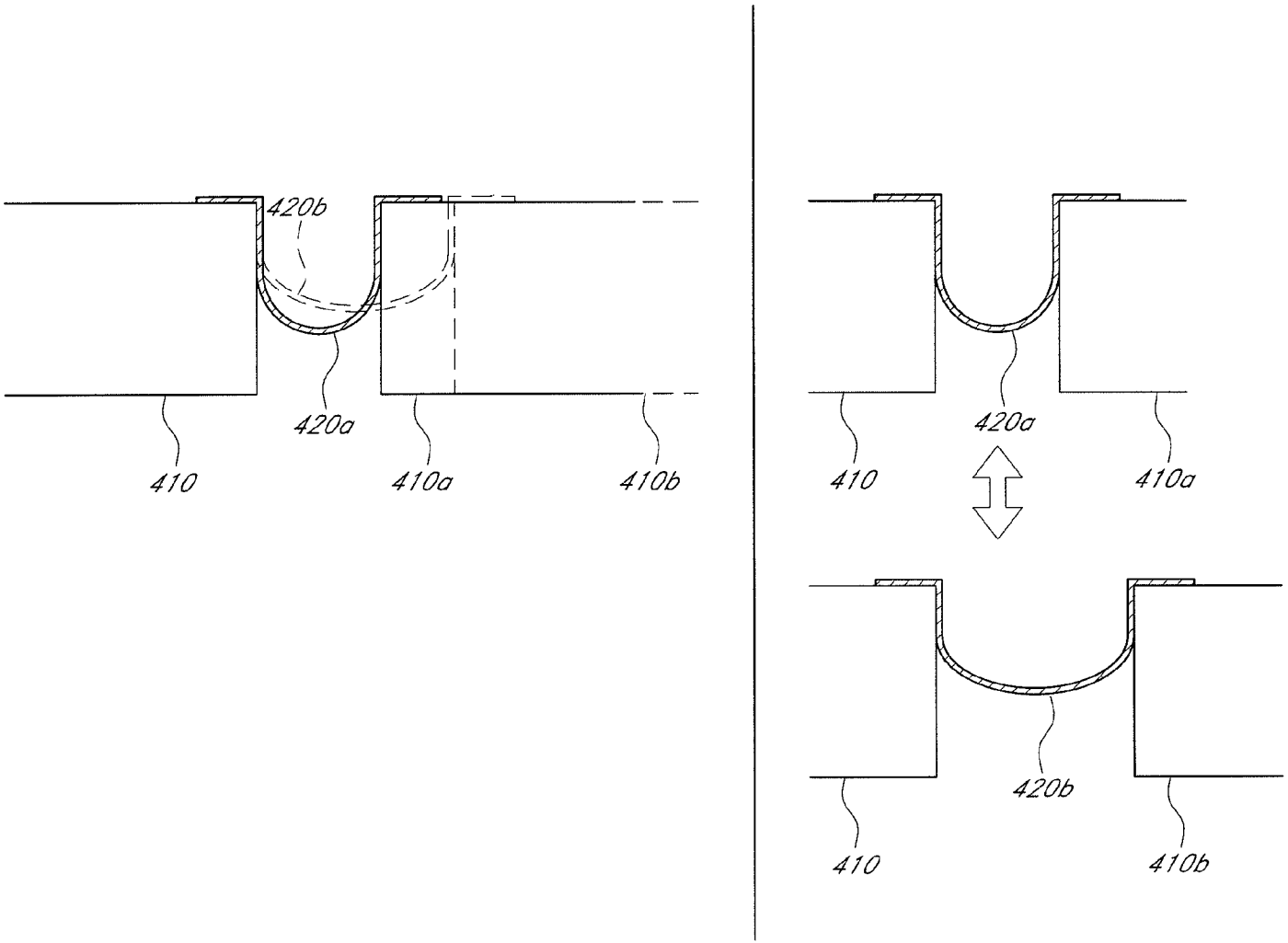
FIG. 4B is a cross-sectional view of one embodiment of a fluid-tight seismic-resistant reservoir cover showing horizontal displacement of a panel.

FIG. 4B is a cross-sectional view of one embodiment of a fluid-tight seismic-resistant reservoir cover showing horizontal displacement of a panel. In this figure, the panels 410 and 410*a* are coupled by a membrane 420*a*. The panel 410*a* is displaced from the position shown to the position illustrated by the panel 410*b*. The membrane 420*a* displaces to the position illustrated by the membrane 420*b* as it stretches while remaining coupled to the panels 410 and 410*b*. The position shown by the membrane 420*b* and the panel 410*b* is presented for illustrative purposes, and may be another position than the position illustrated by the membrane 420*b* and the panel 410*b*. In extreme dislocations, as the membrane 220 is pulled taut most of the membrane may be positioned substantially near to the same plane as the surface of the panels 410 and 410*b*.

Figure 4C:
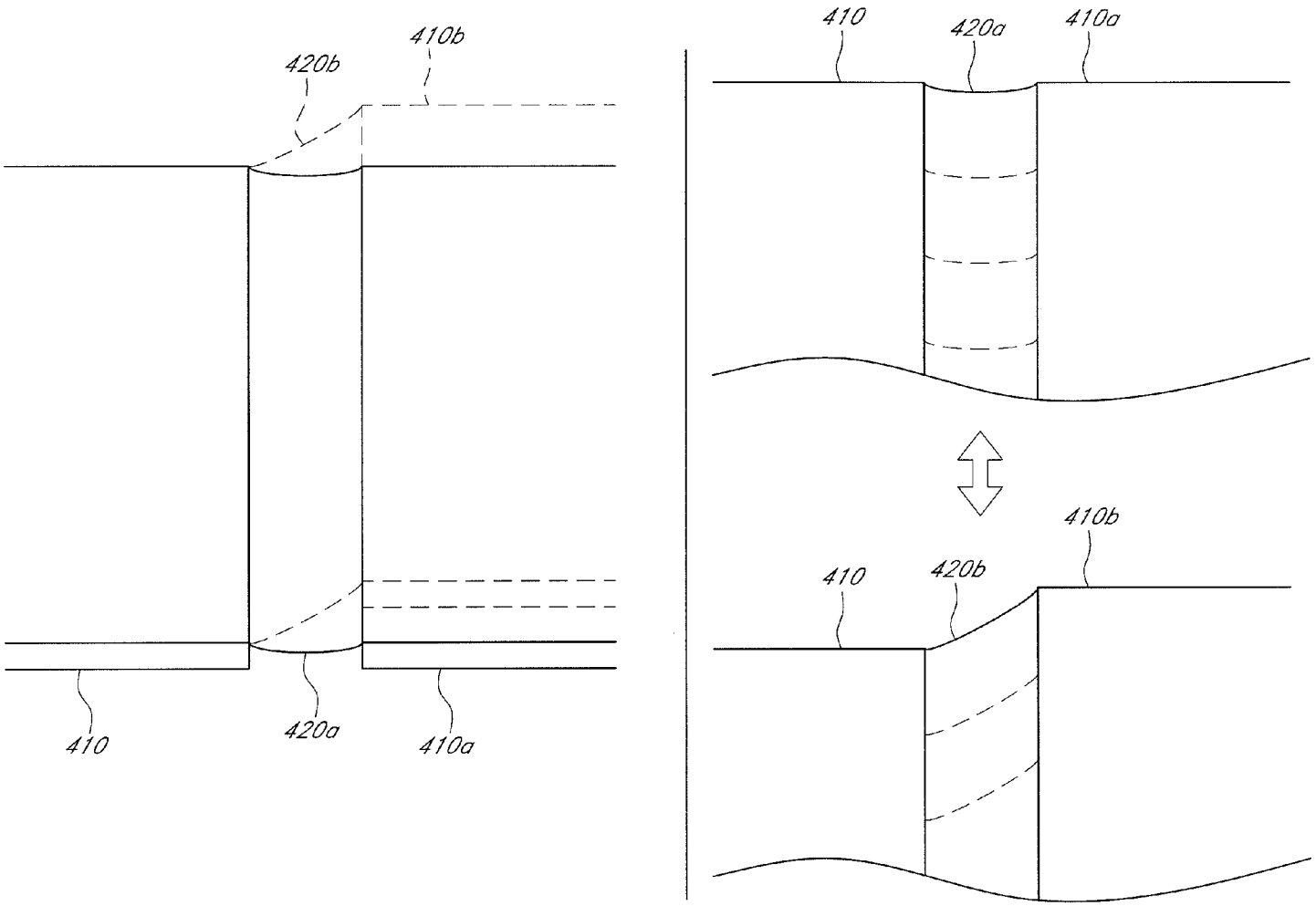
FIG. 4C is a top-down view of one embodiment of a fluid-tight seismic-resistant reservoir cover showing lateral displacement of a panel.

FIG. 4C is a top-down view of one embodiment of a fluid-tight seismic-resistant reservoir cover showing lateral displacement of a panel. In this figure, the panels 410 and 410*a* are coupled by a membrane 420*a*. The panel 410*a* is displaced from the position shown to the position illustrated by the panel 410*b*. The membrane 420*a* displaces to the position illustrated by the membrane 420*b* as it stretches while remaining coupled to the panels 410 and 410*b*. The position shown by the membrane 420*b* and the panel 410*b* is presented for illustrative purposes, and may be another position than the position illustrated by the membrane 420*b* and the panel 410*b* if the panel 410*a* is displaced more or less than the position shown by 410*b*.

Figure 5:
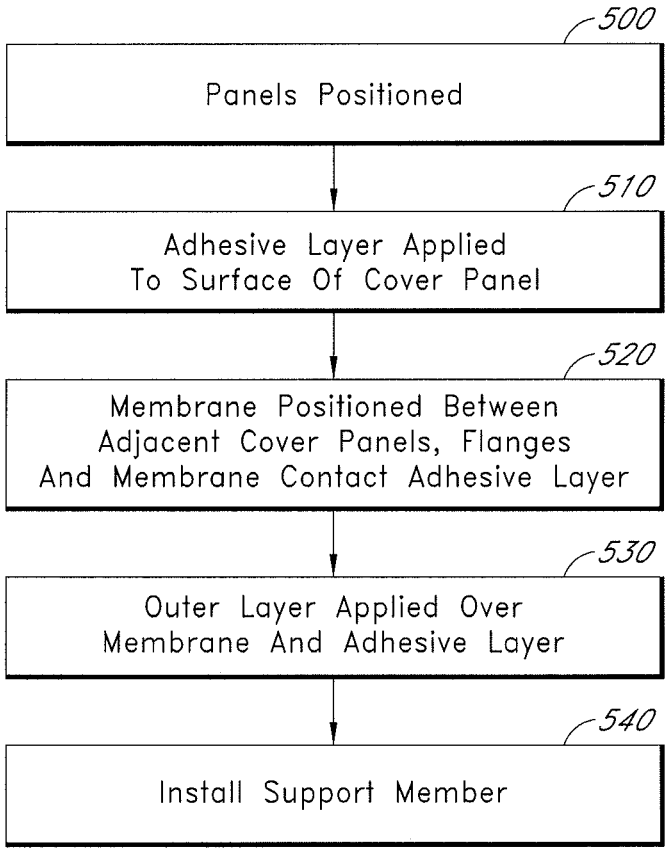
FIG. 5 is a flowchart illustrating one embodiment of a method of forming a fluid-tight seismic-resistant reservoir cover.

FIG. 5 is a flowchart illustrating one embodiment of a method of forming a fluid tight seismic resistant reservoir cover. Depending on the embodiment, the method of FIG. 5 may include fewer or additional blocks and the blocks may be performed in an order that is different than illustrated in FIG. 5.

In block 500 the panels are positioned, and in block 510 an adhesive layer is applied to at least part of the surface of the cover panels.

In block 520, a membrane is positioned in a channel defined by adjacent cover panels, and a flange of the membrane contacts at least part of the adhesive layer. The flanges of the membrane bond to the adhesive layer. The membrane may be positioned so that it extends vertically downward into the channel.

In block 530, an outer layer is applied to the membrane and the adhesive layer. The outer layer may cover all or substantially all of the membrane, the adhesive layer, and the dorsal surface of the cover panel.

In block 540, a support member, for example a backer rod, is positioned adjacent to the membrane in the channel between the cover panels. In some embodiments, the support member may be coated in part or entirely by the outer layer.

In this embodiment of the method, the panels may be put into their desired position before the adhesive layer, membrane, and outer layer are coupled to the panels. This may eliminate the need to perform some of the method prior to the positioning of the panels, which may allow more efficient positioning of the panels by eliminating the need to bring in the panel positioning equipment, replace it with equipment used to perform another part of the method, and again bring in the panel positioning equipment. Also, the panels may be positioned without concern for damaging the results of any previously performed part of the method.

The foregoing description details certain embodiments, however, it will be appreciated that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A reservoir cover comprising:

a plurality of cover structures that define interlocking channels;

a plurality of flexible membranes spanning the interlocking channels, wherein the flexible membranes are made of a potable water approved material;

an adhesive positioned on an interface of the upper exterior portion of the cover structures and a flange of flexible membranes; and an outer coating positioned over at least a portion of the flexible membranes and over at least a portion of the cover structures;

wherein the plurality of flexible membranes, adhesive, and outer coating comprise the same material and create a monolithic structure creating a fluid tight seal.

2. The reservoir cover of claim 1, wherein the adhesive layer is applied by spraying the adhesive while the adhesive is in a substantially fluid state.

3. The reservoir cover of claim 1, wherein the outer coating is applied by spraying the outer coating while the outer coating is in a substantially fluid state.

4. The reservoir cover of claim 1, wherein the plurality of flexible membranes, adhesive, and outer coating comprise polyurea.

5. The reservoir cover of claim 1, wherein the interlocking channels define a plurality of substantially orthogonal intersections.

6. The reservoir cover of claim 1, wherein the flexible membranes are positioned to extend vertically downward into the interlocking channels.

7. The reservoir cover of claim 1, wherein the interlocking channels define a predetermined distance between adjacent cover structures, and wherein the flexibility of the flexible membrane allows a cover structure to be displaced along any axis, wherein the distance of the displacement allowed is about 50% of the predetermined distance.

8. A reservoir cover comprising:

a plurality of cover structures that define interlocking channels;

a plurality of flexible membranes positioned to extend vertically downward into the interlocking channels, wherein the flexible membranes are made of a potable water approved material;

an adhesive positioned on an interface of the upper portion of the cover structures and the flexible membranes; and a plurality of support members positioned in the interlocking channels.

9. The reservoir cover of claim 8, wherein the flexible membranes each comprise a groove and wherein the support members are positioned in the grooves.

10. The reservoir cover of claim 9, wherein the support members are attached to the flexible membranes with an adhesive.

11. The reservoir cover of claim 8, wherein the plurality of flexible membranes and adhesive the same material and create a monolithic structure creating a fluid tight seal.

12. The reservoir cover of claim 11, wherein the plurality of flexible membranes and adhesive comprise polyurea.

13. The reservoir cover of claim 8, wherein the position of the adhesives allows portions of the flexible membrane to freely disengage contact with the cover structures.

14. The reservoir cover of claim 8, wherein the interlocking channels define a predetermined distance between adjacent cover structures, and wherein the flexibility of the flexible membrane allows a cover structure to be displaced along any axis, wherein the distance of the displacement allowed is about 50% of the predetermined distance.

15. A reservoir cover comprising:

a plurality of cover structures that define interlocking channels;

a plurality of flexible membranes spanning the interlocking channels, the flexible membranes comprising flange portions, wherein the flexible membranes are made of a potable water approved material;

an adhesive positioned on an interface of upper exterior portions of the cover structures and the flange portions of the flexible membranes; and an outer coating positioned over at least a portion of the flange portions of the flexible membranes and over at least a portion of an upper portion of the cover structures, wherein the flexible membrane, the adhesive, and the outer coating are bonded together to form a substantially fluid tight seal.

16. The reservoir cover of claim 15, wherein the plurality of flexible membranes, adhesive, and outer coating comprise the same material and create a monolithic structure.

17. The reservoir cover of claim 16, wherein the plurality of flexible membranes, adhesive, and outer coating comprise polyurea.

18. The reservoir cover of claim 15, wherein the adhesive layer, the flanges, and the outer layer define substantially horizontal seals that are substantially fluid-tight.

19. The reservoir cover of claim 15, wherein the position of the adhesives allows portions of the flexible membrane to freely disengage contact with the cover structures.

20. The reservoir cover of claim 15, wherein the interlocking channels define a predetermined distance between adjacent cover structures, and wherein the flexibility of the flexible membrane allows a cover structure to be displaced along any axis, wherein the distance of the displacement allowed is about 50% of the predetermined distance.

* * * * *